US005469986A

United States Patent [19]

Jang

[11] Patent Number: 5,469,986

[45] Date of Patent: Nov. 28, 1995

[54] FRUIT BOX

[76] Inventor: Keun H. Jang, 473, Jungsan-Dong, Kyungsan, Kyungbuk, Rep. of Korea

[21] Appl. No.: 314,002

[22] Filed: Sep. 28, 1994

[30] Foreign Application Priority Data

Oct. 16, 1993 [KR] Rep. of Korea ..... 93-21301 U

[51] Int. Cl.[6] ..... B65D 25/28

[52] U.S. Cl. ..... 220/762; 220/760; 220/772

[58] Field of Search ..... 220/485, 491, 220/493, 495, 752, 760, 763, 769, 770, 772, 773, 774, 762, 772

[56] References Cited

U.S. PATENT DOCUMENTS 1,623,409 4/1927 Hempen et al. ..... 220/763 X
2,056,827 10/1936 Clawson ..... 220/763 X
3,057,508 10/1962 Kimbrough, Jr. ..... 220/772 X
5,337,910 8/1994 Picozza et al. ..... 220/760 X

*Primary Examiner*—Steven M. Pollard
*Attorney, Agent, or Firm*—Birch, Stewart, Kolasch & Birch

[57] ABSTRACT

A fruit box made of metal or synthetic resin is disclosed so as to be able to contain mainly fruits. The invention is made such that a box is formed to be wider at a top and narrower at a bottom thereof so that other similar boxes can be piled within one box. Downward protrusions are formed at both bottom surfaces of the box, grooves are formed at bottom of the protrusion, and supporting frames having elongate holes formed therein are mounted on an edge frame of the box. Connecting bars of the handle are formed with hooking projection pieces and a reinforcing steel wire is inserted therein. The connecting bars of the handle are slidable within the elongate holes so that other boxes can be piled within one box in response to the moving position of the handle or other boxes can be piled in multiple layers on the handle, and the box can be stably lifted up or carried by gripping.

4 Claims, 6 Drawing Sheets

FRUIT BOX

BACKGROUND OF THE INVENTION

1. Field of the Invention

The present invention relates to a box for filling mainly fruits, and more particularly to a fruit box in which a box is made narrower at the bottom and wider at the top and supporting frames perforated with elongate holes at the top portion of an edge frame of the box are formed by protruding and a pair of handles are movably and rotatably inserted into the elongate holes, so that the box can be piled in response to the moved position of the handles and the box can be stably held.

2. Description of Related Art

Conventional fruit boxes are for one time use and made of a material of mainly wood, corrugated cardboard or Styrofoam and the like, which has had problems including an excessive waste of resources. Since it was a structure capable of being held by a few fingers while it was not a method for gripping by all fingers, it was hard to grip and very inconvenient to move.

That is, a case of fruit boxes made of wood has had disadvantages that it is somewhat firm but heavy, and since it is a structure in which the top and bottom of the box are the same size and assembling and disassembling are impossible whereby it is impossible to stack by putting one upon another, its volume would be large, and since it is a degree that handles are protruded a little to both sides of top surface of the box, it is very inconvenient to grip by hand.

A case of boxes made of corrugated cardboard has had disadvantages that since it was a structure capable of folding and unfolding, volume can be made small at the time of carrying or storing, but at a time of using or storing, a troublesome working process to fold or unfold the box one by one has to be passed, and since firmness was also worse, it would be easily damaged even against weak shock and it was weak against moisture.

Further, a case of fruit boxes made of styrofoam has had disadvantages that even though the weight was light the firmness was relatively lower, and it was easily damaged, and damaged pieces pollute the surrounding environment. Since most of it was a structure being unable to stack, volume becomes large in case of storing empty cases.

OBJECT AND SUMMARY OF THE INVENTION

The present invention, in order to solve such disadvantages that fruit boxes of conventional types as described above include, providing a fruit box capable of semi-permanent use by injection molding the box by material of synthetic resin or metal, capable of reducing a stacking volume by heaping up the boxes without a folding or unfolding process, and capable of stably holding the box.

In order to accomplish these objects, the present invention is made such that the box is formed to be wider at the top and narrower at the bottom, including supporting frames perforated with elongate holes protruding from a top surface of the frame edge, and a pair of handles slidably inserted into the elongate holes of the supporting frames, so that other boxes can be piled within one box in response to the sliding position of the handles, other boxes can be stacked in multiple on the handles, or the box can be held (or gripped) by hand, and a reinforcing steel wire is inserted into the handle and stacked with the box whereby firmness of the handle is increased.

DETAILED DESCRIPTION OF THE PREFERRED EMBODIMENTS

Figure 1:
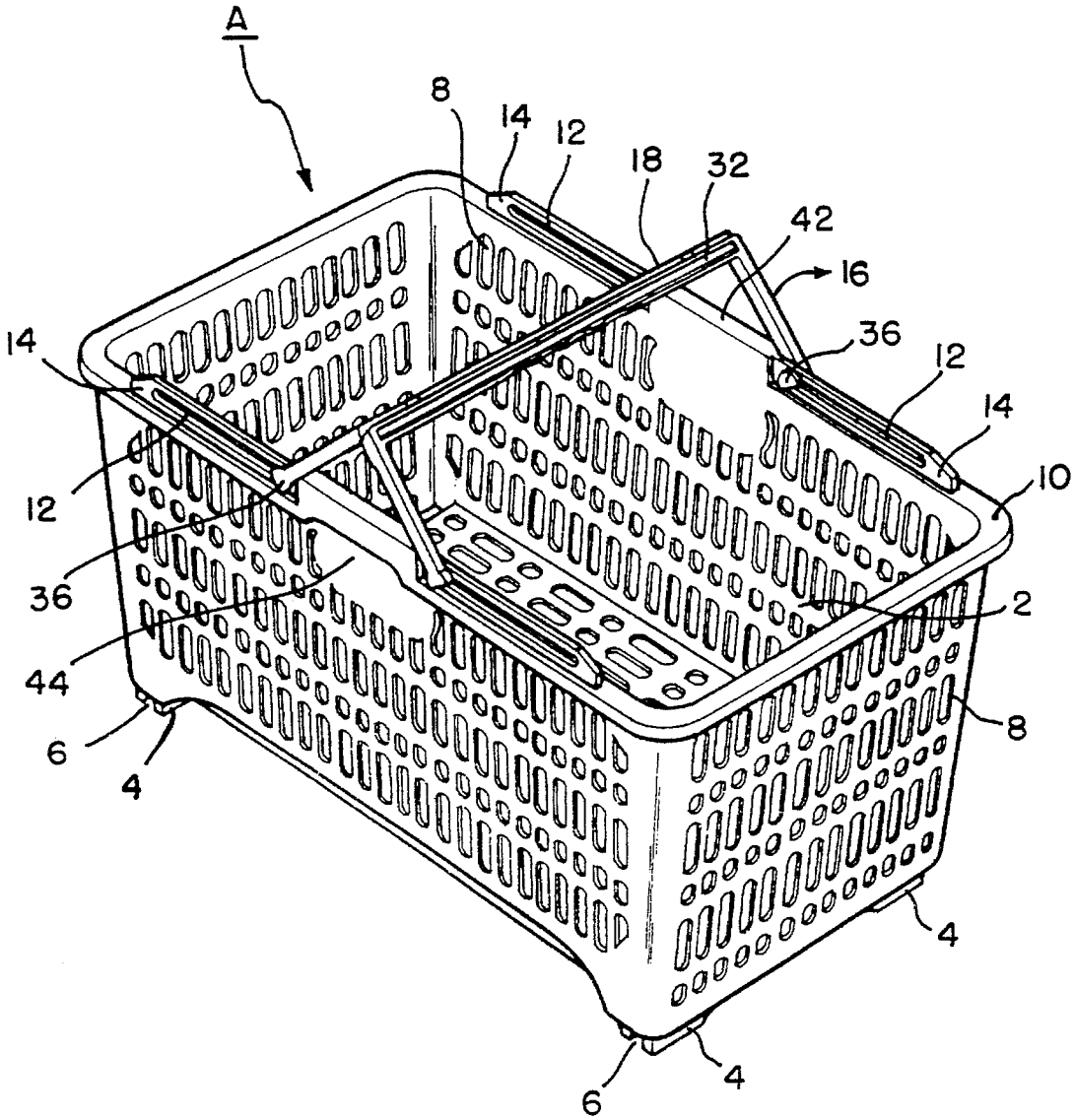
FIG. 1 is a perspective view of the present invention.

Hereinafter, a preferred embodiment of the present invention will be described more in detail with reference to the accompanying drawings.

A containing enclosure 2 is formed by injection molding a material of synthetic resin or metal so as to be wider at the top and narrower at the bottom and to be opened toward the top. Protrusions 4 projecting a predetermined distance from the bottom surface of the enclosure 2 are formed at both sides of the bottom of the containing enclosure 2. Downward grooves 6 are formed lengthwise at a bottom surface of the protrusions 4, a multiplicity of long and short through holes 8 are formed at each side and bottom surfaces of the containing enclosure 2, and supporting frames 14 formed with elongate holes 12 are formed by protruding to the right and left of the top surface of an edge frame 10 so as to be made one piece with the edge frame 10.

The groove 6 is desirable to be formed to be somewhat wider when downwardly directed so as to be easily put on a handle grip 18, and it can be directly formed at a bottom surface of the bottom of the protrusion 4.

Hooking projection pieces 22 having a sloped surface 20 are formed to both sides of the front surface of handle grip 18 of handles bent substantially ⌐shaped so that front and back movement of the box to be stacked is prevented, and recessed grooves 24 are formed lengthwise on the back surface of the handle 16, and snapping pieces 30 formed with snap-in groove 28 and oppositely sloped groove openings 26 are made in multiple with suitable intervals within the recessed groove.

A reinforcing steel wire 32 which is made by antioxidant or applied with antioxidant on an exterior surface and having an outer diameter the same or almost the same as an inner diameter of snap-in groove 28 is fixed into the snap-in groove by forcible insertion through a groove opening.

A rugged surface 34 is formed at one side of a substantially central portion of the handle grip 18 so that it is easily gripped by hand, a pair of hooking pieces 36 which are semicircular in section are connected by a connecting bar 38 at an end of a bent portion of the handle 16 so that the hooking pieces 36 are confronted with a predetermined distance, and the connecting bar 38 of the handle is inserted into the elongate hole 12 of the supporting frame so that the connecting bar 38 is slidable within the elongate hole 12, and thereby the fruit box A is made.

In the above description, reinforcing ribs which are narrow in width and somewhat protruded would be formed in multiple at an external surface of the box A if necessary, or they may be excluded.

Unexplained reference numeral symbols are as follows.

(40) is extra space, (42) is a reinforcement of the supporting frame, and (44) are grips formed at front and rear surfaces of the edge frame.

Figure 2:
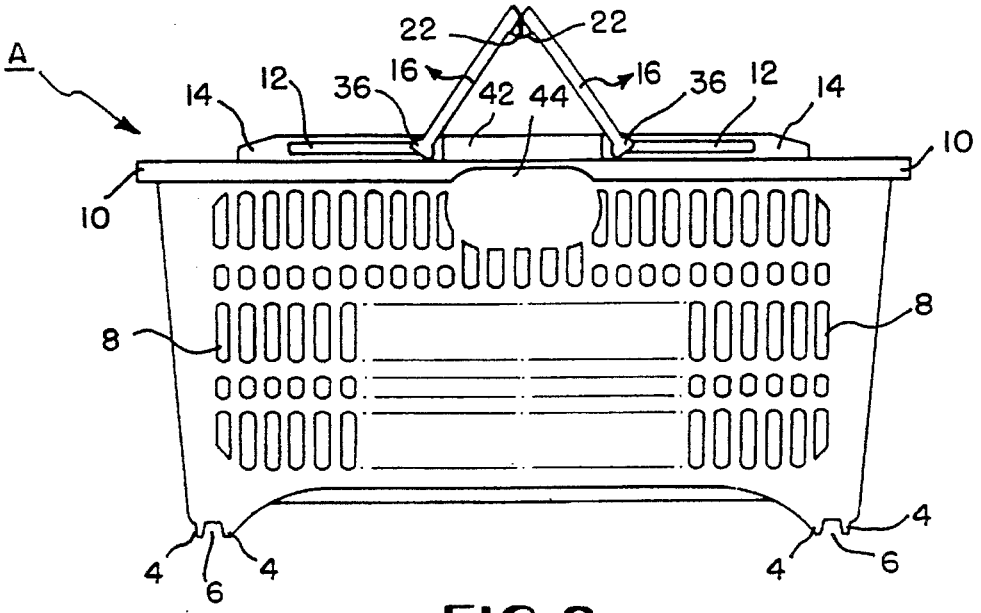
FIG. 2 is a front view of the present invention, which shows a state that handles are contacted with one another.

The present invention made by the above construction is used by appropriately moving the position of the handle 16 in response to the using state of the box A, and in case when the box is required to move in a state that contents (e.g., fruits) are filled into the containing enclosure 2 or it is empty, as shown in FIG. 2, when a pair of handles 16 are moved to the center and one handle 16 and another handle 16 are made to be abutted against one another, the sloped surface 20 of time hooking projection piece 22 end the corner surface of the handle grip 18 are abutted against each other whereby the handle 16 and the edge frame 10 are made in a triangular form which is stable in structure.

When substantially central portions of the handle grips 18 are abutted against each other the handle is gripped and held up by one hand or two hands, since the handle grip 18 is located at center of the box A and it is a triangular structure, the box A is not inclined to the right or left side whereby it can be stably moved.

In the above description, when the contents are filled in the box A or a magnitude of the box A is relatively large and thereby two persons are going to hold together, when they are moved such that the connecting bar 38 of the handle is moved to be positioned to outer side and then two handles 16 are respectively held and moved, it will be easily done.

Figure 3:
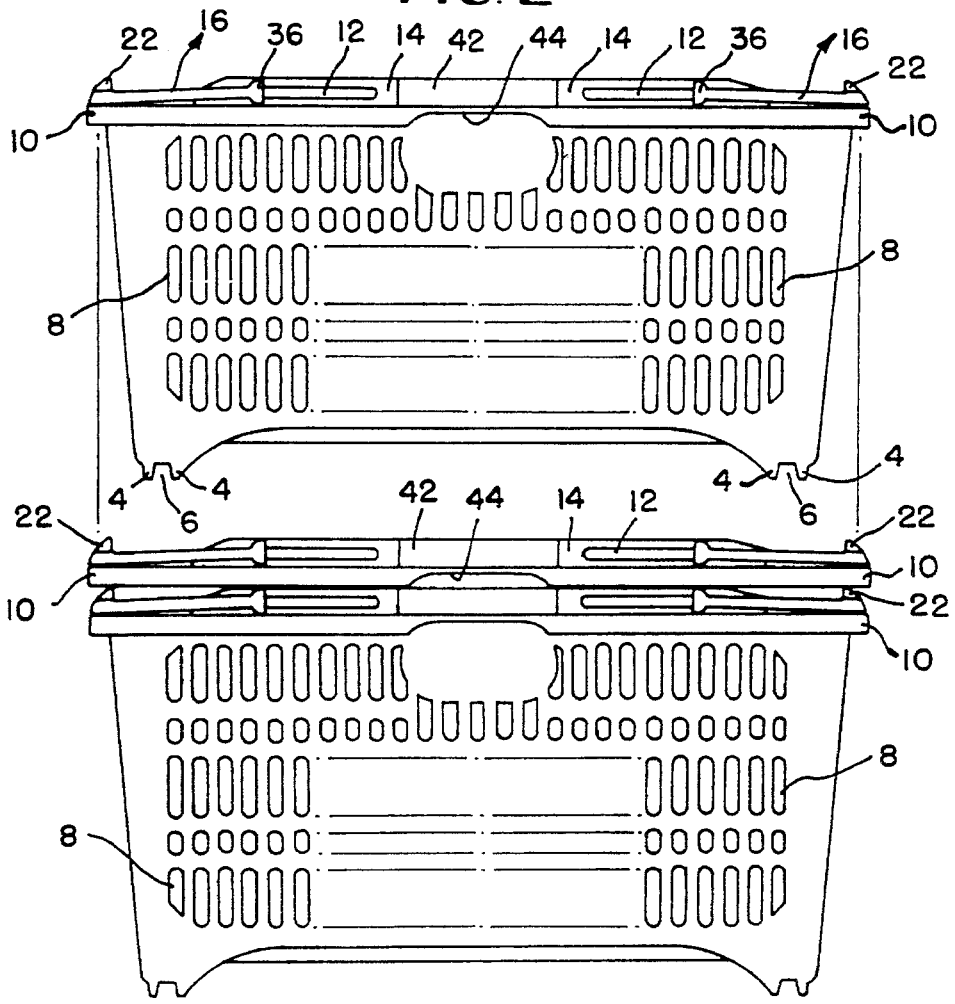
FIG. 3 is a front view of the present invention, which shows a state that the box is put upon another and stacked.
Figure 4:
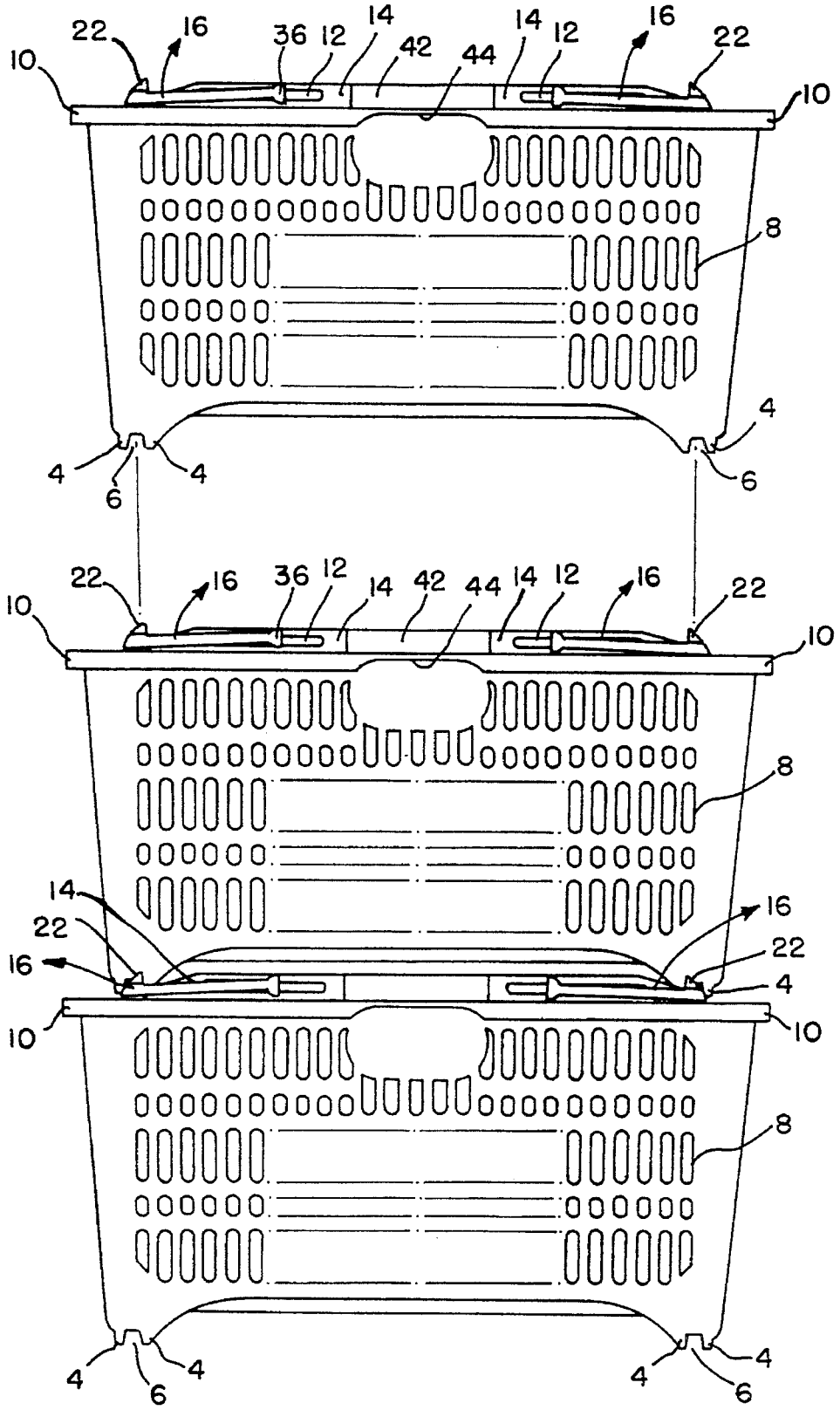
FIG. 4 is a front view of the present invention, which shows a state that the boxes are stacked in multiple layers on the handle.
Figure 5A:
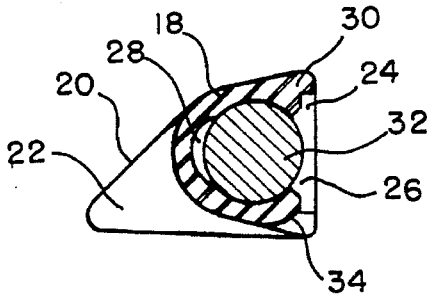
FIG. 5(A) is a cross sectional view of a handle of the present invention.
Figure 5B:
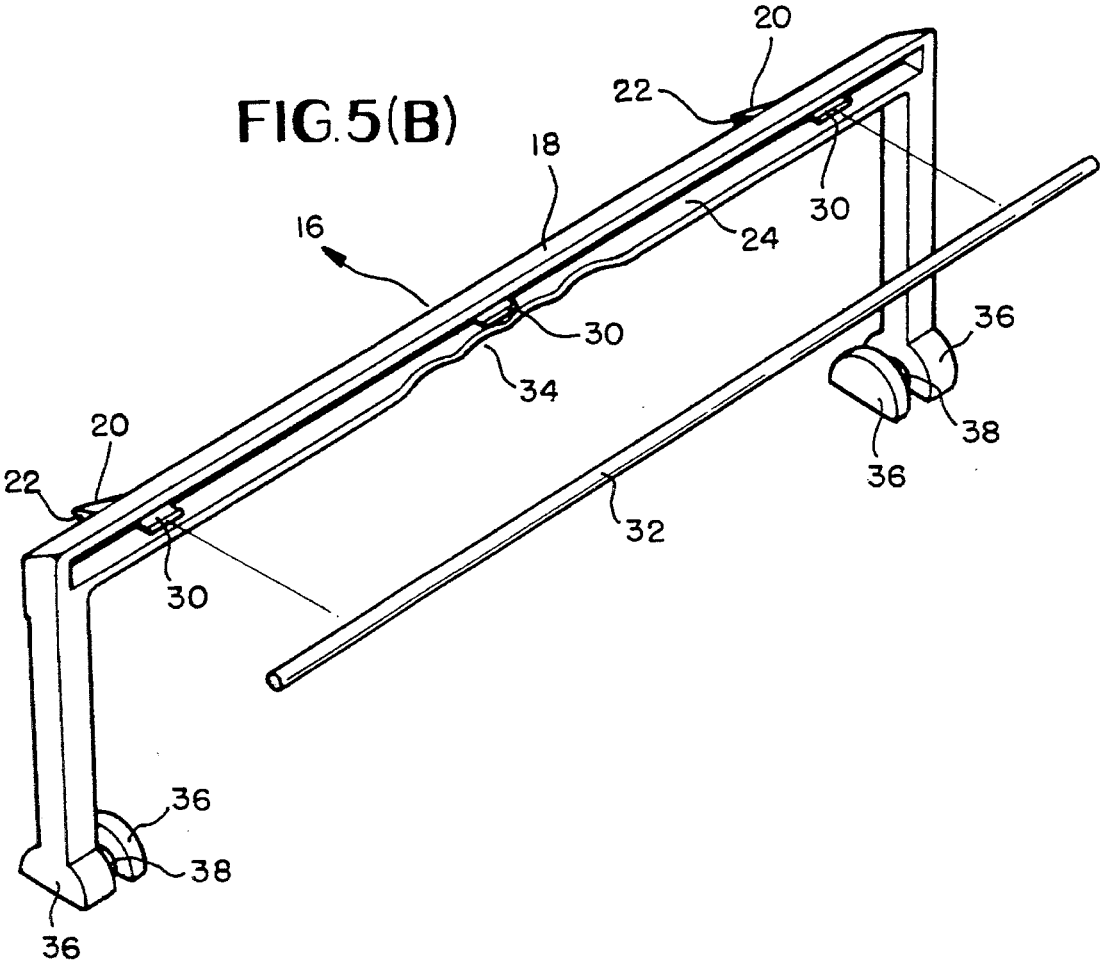
FIG. 5(B) is an exploded perspective view of the handle of the present invention.

In the case of desiring to store or move empty boxes, as shown in FIG. 3, when they are moved such that the connecting bars 38 of the handle are positioned to the outer side of the elongate holes 12, a back surface of the handle 16 is made to contact the top surface of the edge frame 10 and then another box A' is piled up within the containing enclosure 2 of the box A, since the stacking height of the boxes becomes greatly lower, moving, carrying and storing of the boxes is easy.

Moreover, in case of desiring to hear, up the boxes after filling up the contents (e.g., fruits) within the containing enclosure 2, when both handles 16 are pushed to a central portion of the box in a state which is made such that a back surface of the handle 16 is contacted to the top surface of the edge frame 10, the handle grip 18 is abutted to a side surface of the supporting frame 14 whereby no more can be advanced.

In the above state, another box A" contained with contents is lifted up and is made such that the recessed groove of the box A" is laid on the handle grip 18 of the lower box, such that the box with contents can be stacked up in multiple layers.

In the above description, since extra space 40 as much as downwardly protruded distance of the protrusion 4 is produced between the lower box A and the upper box A" by the protrusion 4, even if one or two fruits contained within the containing enclosure of the lower box A are excessively over the top surface of the edge frame 10, since they do not contact the bottom surface of the upper box A", damage of the fruit is prevented, and the fruits become more excessively contained to the lower box A.

Figure 6:
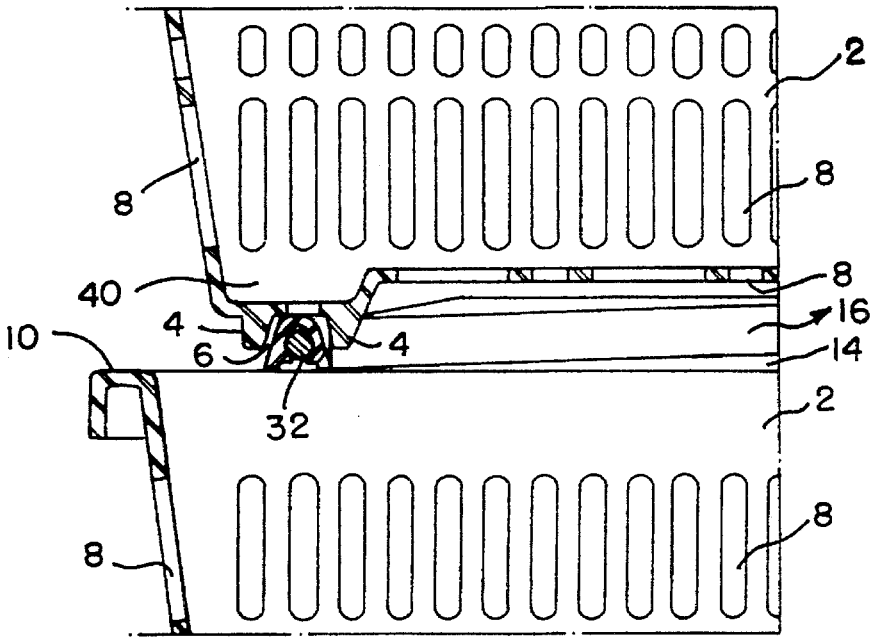
FIG. 6 is a cross sectional view of FIG. 4 of the present invention, which shows a state that a groove of an upper box is laid on a top surface of the handle of a lower box so that right and left movement of the box is prevented.
Figure 7:
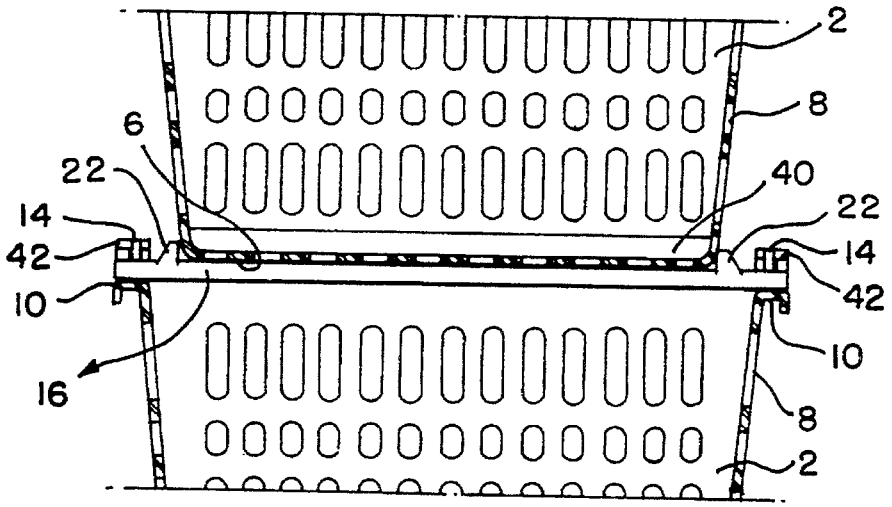
FIG. 7 is a longitudinal cross sectional view of FIG. 4 of the present invention, which shows a state that bottom surface of upper box is placed between hooking projection pieces of the handle of a lower box so that front and back movement of the box is prevented.
Figure 8:
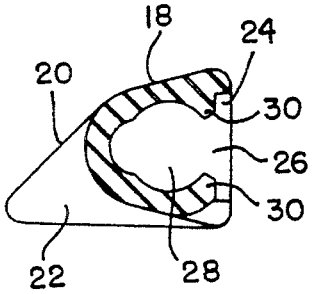
FIG. 8 is a cross sectional view of the handle of the present invention.

Both side surfaces of the piled box A", as shown in FIG. 7, are prevented from moving forward and backward by the hooking projection pieces 22 of the handle, and as shown in FIG. 6, since the groove 6 is laid on the handle grip 18 and hooked and the handle 16 is contacted to the side surface of the supporting frame 14, right and left movement of the box is also prevented.

Since another box having contents can be piled up in multiple layers by the aforesaid method to the top of the piled box A" whereby piling space becomes little and since the handle 16 supporting the upper box is greatly increased in supporting capacity (bearing capacity) by the reinforcing steel wire 32 contained therein, they can be worn even to much piling weight.

And, when reinforcing ribs are vertically made to be protruded on the side surface of the box, up and downward supporting capacity of the box is increased, and when a thickness of the protruded reinforcing rib is formed to be thicker or a multiplicity of them are formed with predetermined intervals, the up and downward supporting capacity of the box is further increased.

Figure 9:
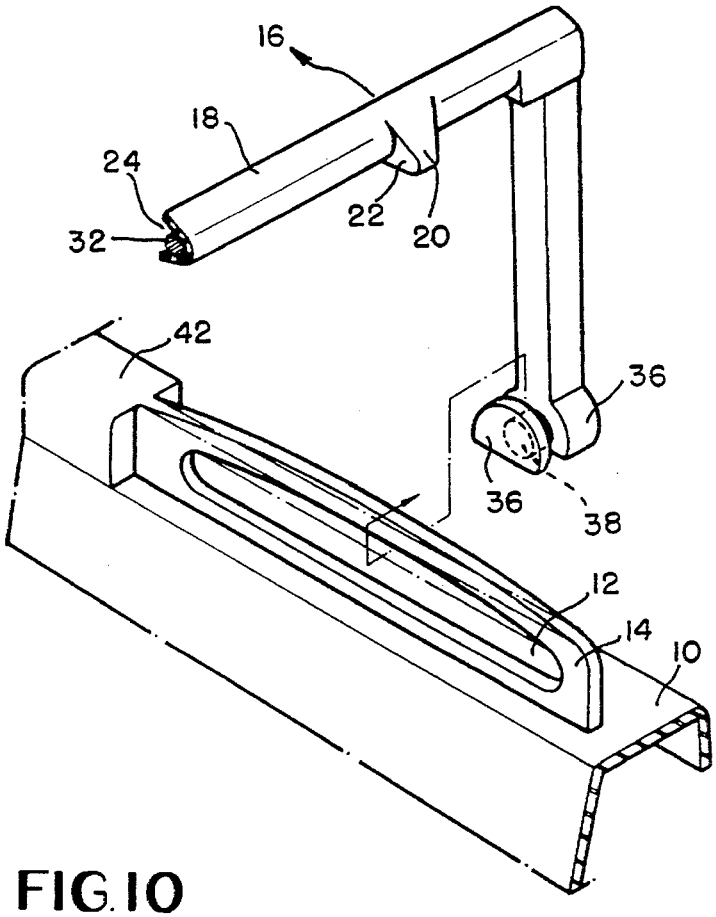
FIG. 9 is a perspective view of a state that the handle of the present invention is inserted into or released from the supporting frame.

When the handle 18 is inserted into or released from the supporting frame 14 in accordance with the requirement, as shown in FIG. 9, the top of the supporting frame 14 is moved in the direction of the arrow whereby the hooking piece 36 of the interior is inserted into or released therefrom and then the top of the supporting frame 14 which has been moved is released, since the supporting frame 14 is returned to an original state, a releasing or coupling of the handle 16 can be easily done, and a shape of the hooking piece 36 may be made to be circular, but it is made to be semicircular, whereby the inserting into and releasing from the supporting frame 14 is relatively easy.

Since the box of the present invention is made of a material of synthetic resin or metal, its useful life is semi-permanent and its manufacturing cost is low, regeneration is possible whereby resources can be reused, and since it is strong against moisture, different from the corrugated cardboard box, it can be used even when snow or rain is present and open air storing is also possible.

Moreover, not only for agricultural and marine products as fruits but articles used for life also can be contained, and since existing boxes are made so as to be able to contain the contents mostly by unit of 10 kg, 15 kg, 20 kg or more, not only are they heavy but they also have no handle to firmly grip the box, and were difficult for carrying by the old and weak. However since the box of the present invention is injection molded by a material of metal or synthetic resin, it is easy to make by classifying to a magnitude of various sizes such as small, small-medium, medium, medium-large, and large, and the boxes made of various sizes can be selectively used for a box of magnitude fitting any use.

Figure 10:
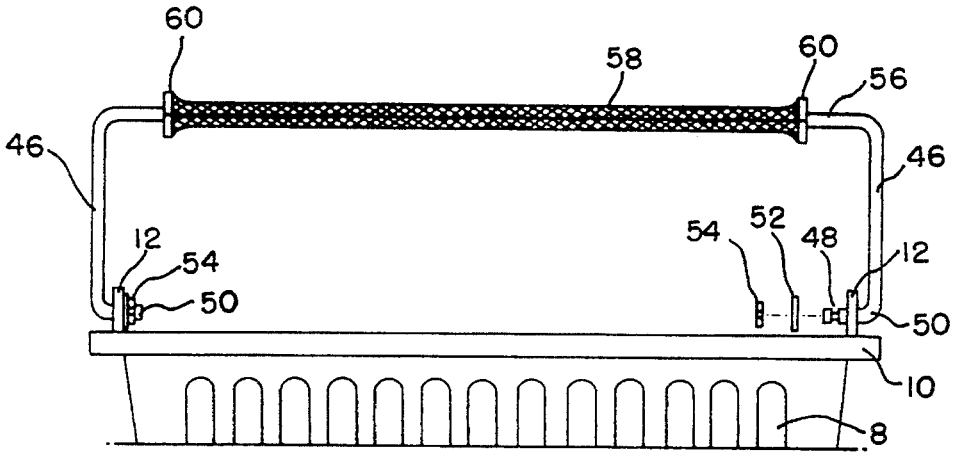
FIG. 10 is a front view of another embodiment of handle of the present invention.

FIG. 10 is a view of another embodiment of the handle in accordance with the present invention, in which inwardly bent end portions 50 are formed with an annular groove 48 after a steel wire 46 bent in "⊏⊐"-shape inserted into the elongate hole 12 of the supporting frame in a sliding movement. Washer 52 is inserted to the inserted bent portion 50, a C-ring 54 is forcibly inserted into the annular groove 48, a gripping bar 58 made of soft material is injection molded or forcibly inserted to an external surface of the handle portion 56, and a stopper ring 60 is made to be protruded at both ends so that front and backward movement of the box piled at top of the gripping bar 58 is prevented and used as well.

As described above, since the box of the present invention is made by synthetic resin and the handle is formed at the top of the frame surface of the box to be able to rotate and move forwardly and backwardly, there is the effect that the box can be held stably, and other boxes can be piled within a containing enclosure of one box or else other boxes can be piled in multiple layers on the handle.

What is claimed is:

1. A box comprising:

a containing enclosure formed to be wider at an open end thereof and narrower at a closed end thereof;

a pair of grooves formed on opposing transverse ends of the closed end of said enclosure, said pair of grooves being parallel to each other;

an edge frame formed at a peripheral edge of the open end of said enclosure;

a pair of supporting frames formed on opposing longitudinal surfaces of said edge frame, each of said pair of supporting frames having an elongate hole formed therein;

a pair of handles pivotally and slidably mounted at a connection end thereof within the elongate holes of said pair of supporting frames, said pair of handles including a gripping portion opposite the connection end thereof;

a reinforcing member formed within the gripping portion of each of said pair of handles;

at least one hooking projection piece formed on the gripping portion of a first one of said pair of handles; and at least one resilient piece formed on the gripping portion of a second one of said pair of handles for receiving said at least one hooking projection piece in a snap-fit manner;

wherein the pair of handles are independently slidable within the elongate holes at the connection ends thereof for enabling a first position of horizontal mating with said edge frame and a second position of joining the pair of handles together by a snap-fit connection.

2. The box according to claim 1, wherein the connection ends of said pair of handles are bent for insertion into the elongate holes.

3. The box according to claim 1, wherein the connection ends of said pair of handles are linear and include a first hooking piece formed at a distal end thereof joined to a second hooking piece by a connecting bar, the connecting bar fit within the elongate hole.

4. The box according to claim 1, further comprising a gripping bar formed on the gripping portion of said pair of handles and stopper rings formed at opposing ends of said gripping bar.

* * * * *